US010184642B2

(12) United States Patent
Geels et al.

(10) Patent No.: US 10,184,642 B2
(45) Date of Patent: Jan. 22, 2019

(54) ROTATIONALLY ADJUSTABLE LAMP AND MANUFACTURING METHOD

(71) Applicant: PHILIPS LIGHTING HOLDING B.V., Eindhoven (NL)

(72) Inventors: Marijn Geels, Eindhoven (NL); Peter Johannes Martinus Bukkems, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/327,219

(22) PCT Filed: Jul. 16, 2015

(86) PCT No.: PCT/EP2015/066223
§ 371 (c)(1),
(2) Date: Jan. 18, 2017

(87) PCT Pub. No.: WO2016/012330
PCT Pub. Date: Jan. 28, 2016

(65) Prior Publication Data

US 2017/0146220 A1 May 25, 2017

(30) Foreign Application Priority Data

Jul. 21, 2014 (EP) ..... 14177750

(51) Int. Cl.
*F21S 4/00* (2016.01)
*F21V 14/02* (2006.01)
(Continued)

(52) U.S. Cl.
CPC ..... *F21V 14/02* (2013.01); *F21K 9/23* (2016.08); *F21K 9/90* (2013.01); *F21V 17/06* (2013.01); *F21V 19/001* (2013.01); *F21V 19/02* (2013.01); *F21Y 2105/10* (2016.08); *F21Y 2107/90* (2016.08); *F21Y 2115/00* (2016.08);
(Continued)

(58) Field of Classification Search
CPC ..... F21V 14/02; F21V 19/001; F21V 17/06; F21K 9/90
See application file for complete search history.

(56) References Cited

U.S. PATENT DOCUMENTS 4,121,134 A 10/1978 Fontenelle
5,921,660 A 7/1999 Yu
(Continued)

FOREIGN PATENT DOCUMENTS

CN 201448662 U 5/2010
CN 201935010 U 8/2011
(Continued)

*Primary Examiner* — Evan Dzierzynski
(74) *Attorney, Agent, or Firm* — Akarsh P. Belagodu

(57) ABSTRACT

A method for manufacturing a rotationally adjustable lamp (1) is disclosed. The method comprises: molding a shell (6) having a guiding slot (7*a*); providing a base (2) configured to receive the shell (6) and connect to a lamp socket; inserting the shell (6) into the base (2) so as to enclose the guiding slot (7*a*) by the base (2); and forming in the base (2), when the shell (6) is inserted into the base (2), a notch (5) protruding into the guiding slot (7*a*), the notch (5) being movable along the guiding slot (7*a*) so as to allow for the shell (6) to be rotated relative to the base (2).

12 Claims, 4 Drawing Sheets

(51) Int. Cl.

| | |
|---|---|
| ***F21K 9/90*** | (2016.01) |
| ***F21K 9/23*** | (2016.01) |
| ***F21V 19/02*** | (2006.01) |
| ***F21V 17/06*** | (2006.01) |
| ***F21V 19/00*** | (2006.01) |
| *F21Y 115/30* | (2016.01) |
| *F21Y 115/10* | (2016.01) |
| *F21Y 115/15* | (2016.01) |
| *F21Y 107/90* | (2016.01) |
| *F21Y 115/00* | (2016.01) |
| *F21Y 105/10* | (2016.01) |

(52) U.S. Cl.
CPC ..... *F21Y 2115/10* (2016.08); *F21Y 2115/15* (2016.08); *F21Y 2115/30* (2016.08)

(56) References Cited

U.S. PATENT DOCUMENTS

| | | | | |
|---|---|---|---|---|
| 8,147,267 | B2 | 4/2012 | Oster | |
| 2002/0012246 | A1* | 1/2002 | Rincover | F21L 4/00 362/186 |
| 2009/0267481 | A1 | 10/2009 | Verheyen | |
| 2011/0050072 | A1 | 3/2011 | Liu | |
| 2011/0241529 | A1 | 10/2011 | Matsui et al. | |
| 2013/0286645 | A1* | 10/2013 | Bukkems | F21K 9/90 362/227 |
| 2015/0022073 | A1* | 1/2015 | Moon | F21K 9/1355 313/11 |

FOREIGN PATENT DOCUMENTS

| | | | |
|---|---|---|---|
| CN | 202303207 | U | 7/2012 |
| WO | WO2014087357 | A1 | 6/2014 |

* cited by examiner

ROTATIONALLY ADJUSTABLE LAMP AND MANUFACTURING METHOD

CROSS-REFERENCE TO PRIOR APPLICATIONS

This application is the U.S. National Phase application under 35 U.S.C. § 371 of International Application No. PCT/EP2015/066223, filed on Jul. 16, 2015, which claims the benefit of European Patent Application No. 14177750.8, filed on Jul. 21, 2014. These applications are hereby incorporated by reference herein.

TECHNICAL FIELD

The present disclosure relates to a rotationally adjustable lamp and to a method for manufacturing such a lamp.

BACKGROUND

Lamps today come in a variety of shapes. This is particularly true for lamps based on solid-state lighting (SSL) technology which facilitates the production of lamps having shapes that are difficult to achieve using traditional incandescent technology. While allowing for many creative and effective lighting solutions, the use of lamps not having the conventional pear-like shape requires some special considerations.

Lamps are usually designed to be screwed into a socket connecting the lamp to an electrical power source. The rotational orientation of a fully screwed-in non-rotationally symmetric lamp may have to be adjusted in order for the lamp to provide optimal illumination. For example, a substantially flat lamp may need to be aligned with a nearby wall for even diffusion of light in a space. Correct rotational positioning is of course particularly important to make the best use of directional lamps. An example of a light bulb base enabling rotational adjustment of an LED device without breaking the electrical connection is disclosed in U.S. Pat. No. 8,147,267 B2. The base has a slot for receiving a tab attached to a mounting for an LED device which can be rotated until the tab reaches an end of the slot.

It is desirable that the manufacturing of rotationally adjustable lamps be cost-effective and simple. Existing manufacturing methods can be improved in these respects.

SUMMARY

A general objective of the present disclosure is to provide an improved or alternative method for manufacturing lamps that can be rotationally adjusted without being electrically disconnected. The cost-effectiveness and simplicity of the method are aspects of particular interest.

The invention is defined by the independent claims. Embodiments are set forth in the dependent claims, the description and the drawings.

According to a first aspect, a method for producing a rotationally adjustable lamp is provided. The method comprises: molding a shell having a guiding slot; providing a base configured to receive the shell and connect to a lamp socket; inserting the shell into the base so as to enclose the guiding slot by the base; and forming in the base, when the shell is inserted into the base, a notch protruding into the guiding slot, the notch being movable along the guiding slot so as to allow for the shell to be rotated relative to the base.

This method provides for a cost-effective way to manufacture lamps that can be rotationally adjusted without being electrically disconnected. The method can be implemented using conventional tools and techniques.

The guiding slot may be arranged in a cylindrical portion of the shell, the guiding slot extending along the circumference of the cylindrical portion and perpendicular to the height of the cylindrical portion. The guiding slot may extend for about 180 degrees. The shell may have an additional guiding slot, the two guiding slots of the cylindrical portion forming a pair of oppositely arranged guiding slots on the cylindrical portion of the shell. An additional pair of oppositely arranged guiding slots may be arranged on the cylindrical portion of the shell, the two pairs of guiding slots being separated along the height of the cylindrical portion.

The shell may be injection molded. Molding the shell may comprise molding a first half and a second half of the shell. This may enable a simple, fast and cost-effective manufacturing process since the simple design of the guiding slot allows for the halves to be molded using low-cost molds without undercuts.

The method may comprise providing a carrier having at least one light source and enclosing the carrier between the first and second halves of the shell, before the shell is inserted into the base. The light source may be an SSL device. The light source may be a semiconductor light-emitting diode, an organic light-emitting diode, a polymer light-emitting diode or a laser diode. The carrier may have a perimeter including a curved portion, wherein the at least one light source is a plurality of light sources arranged along the curved portion of the perimeter on opposite sides of the carrier, and wherein each half of the shell has a flat central area surrounded by a hollow ridge extending along the curved portion of the perimeter of the carrier. The shell may comprise a joint in a plane parallel to a longitudinal axis of the lamp, the first and second halves being attached to each other along the joint.

A rotationally adjustable lamp may be manufactured by any of the alternative methods described above.

According to a second aspect, a rotationally adjustable lamp is provided. The lamp comprises a base, which is provided with a notch and configured to connect to a lamp socket, and a shell supported by the base and provided with a guiding slot. The notch protrudes into the guiding slot and is movable along the guiding slot so as to allow for the shell to be rotated relative to the base. The guiding slot may extend for about 180 degrees.

The second aspect may provide for technical effects which are identical or similar to those of the first aspect.

The shell may have four guiding slots arranged in a cylindrical portion of the shell, each one of the guiding slots extending along the circumference of the cylindrical portion and perpendicular to the height of the cylindrical portion. The four guiding slots may form a first and a second pair of oppositely arranged guiding slots, the two pairs being separated along the height of the cylindrical portion. Each one of the guiding slots may extend for about 180 degrees.

The shell may comprise a first half and a second half, the first and second halves enclosing a carrier having a plurality of light sources arranged on opposite sides of the carrier. The light source may be SSL devices, such as semiconductor light-emitting diodes, organic light-emitting diodes, polymer light-emitting diodes. The light sources may be laser diodes.

It is noted that the invention relates to all possible combinations of features recited in the claims.

BRIEF DESCRIPTION OF THE DRAWINGS

The following figures are included for exemplifying purposes.

In the figures, which are not drawn to scale, similar or identical elements are indicated by the same reference numeral.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
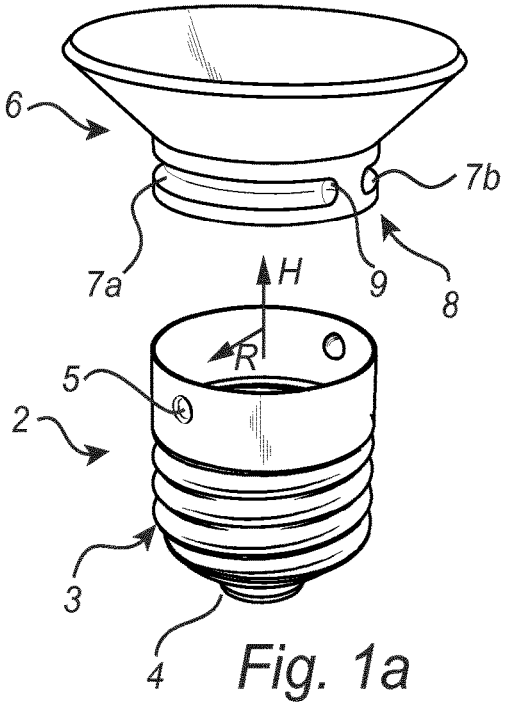
FIGS. 1*a*-1*c* are schematic views of a base and a shell of an example of a rotationally adjustable lamp.

FIG. 1*a* is a schematic perspective view of some components of a rotationally adjustable lamp. FIG. 1*a* shows a base 2 configured to connect to a lamp socket (not shown). The base 2 may comprise a plastic and/or metal. Typically, the base 2 is hollow and has a substantially circularly cylindrical shape defining a height direction H and a radial direction R. The base 2 may have threads 3 allowing the base 2 to be screwed into the lamp socket. The base 2 can have a bottom portion 4 configured to be electrically connected to a power source. The base 2 is provided with at least one notch 5 which usually protrudes radially inwards, i.e. towards the inside of the base 2. The base 2 in FIG. 1 has two notches 5 arranged by the end of the base 2 which is opposite to the bottom portion 4, the threads 3 thus being arranged between the notches 5 and the bottom portion 4 as seen in the height direction H. The notches 5 may be arranged diametrically opposed to each other.

The base 2 is configured to receive a shell 6. The shell 6 may be injection molded. The shell 6 can be made of for example a metal, a thermoplastic and/or a thermosetting polymer. The shell 6 may form a light-transmissive housing for one or more light sources, for example SSL devices. The one or more light sources may be semiconductor light-emitting diodes, organic light-emitting diodes, polymer light-emitting diodes or laser diodes. Alternatively, the shell 6 may be configured to support a housing for one or more light sources. Such a housing may be attached to the shell 6 by chemical means, such as glue, or mechanical means, such as nails, screws or clips. The shell 6 may be provided with threads so that the housing may be screwed onto the shell 6. Soldering may be used to attach the housing to the shell 6.

The shell 6 has at least one guiding slot 7*a*. The guiding slot 7*a* may be arranged in a cylindrical portion 8 of the shell 6, the cylindrical portion 8 being insertable into the base 2. The guiding slot 7*a* typically extends along the circumference of the cylindrical portion 8 and substantially perpendicular to the height of the cylindrical portion 8. The guiding slot 7*a* may extend over any angle around the cylindrical portion 8, for example about 270 degrees, about 180 degrees or about 90 degrees. The shell 6 in FIG. 1*a* has an additional guiding slot 7*b*, the two guiding slots 7*a*, 7*b* together forming a pair of oppositely arranged guiding slots. Each of the guiding slots 7*a*, 7*b* in FIG. 1*a* extends for about 180 degrees along the circumference of the cylindrical portion 8.

Figure 1B:
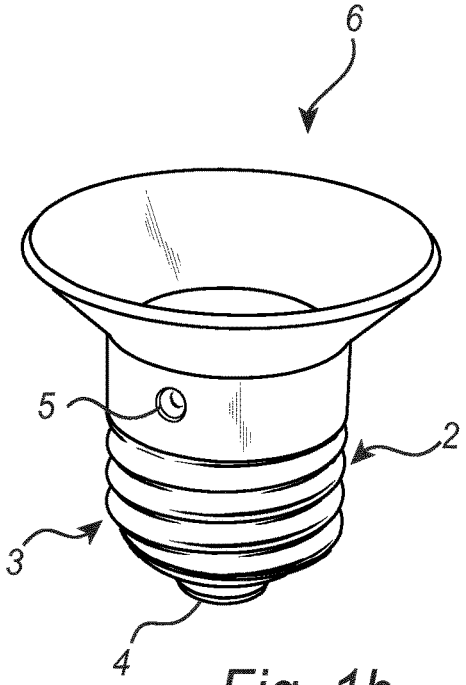

FIG. 1*b* shows a schematic perspective view of the base 2 and the shell 6 of FIG. 1*a* put together. The cylindrical portion 8 of the shell 6 is shown inserted into the base 2 so that the guiding slots 7*a*, 7*b* are enclosed by the base 2. The notches 5 protrude into the guiding slots 7*a*, 7*b* and are movable along the guiding slots 7*a*, 7*b* so that the shell 6 is rotatable relative to the base 2. The relative rotational position between the base 2 and the shell 6 may thus be adjusted.

Figure 1C:
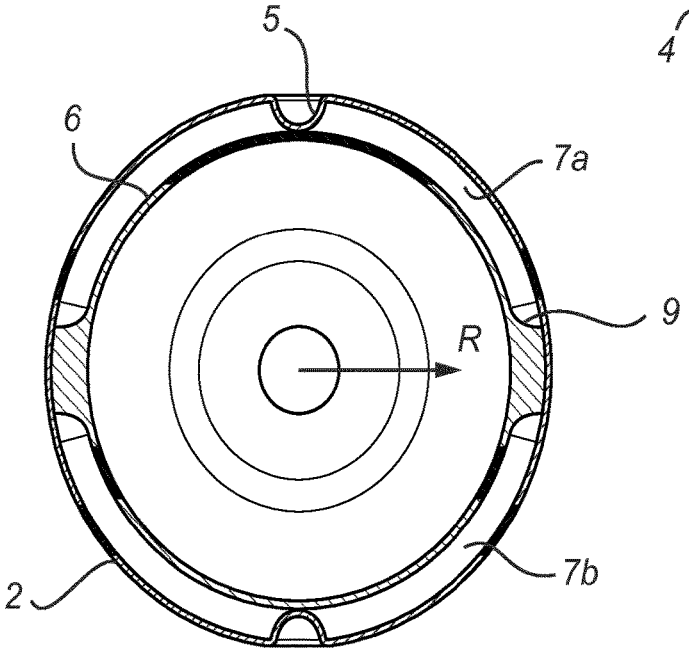

FIG. 1*c* shows schematically a cross-section of the base 2 and the shell 6 from FIG. 1*b* when viewed in the height direction H. The two semicircular paths through which the notches 5 are movable are clearly illustrated. The shell 6 may be rotated clockwise or counterclockwise about an axis in the height direction H until a notch 5 reaches an end 9 of a guiding slot.

Figure 2:
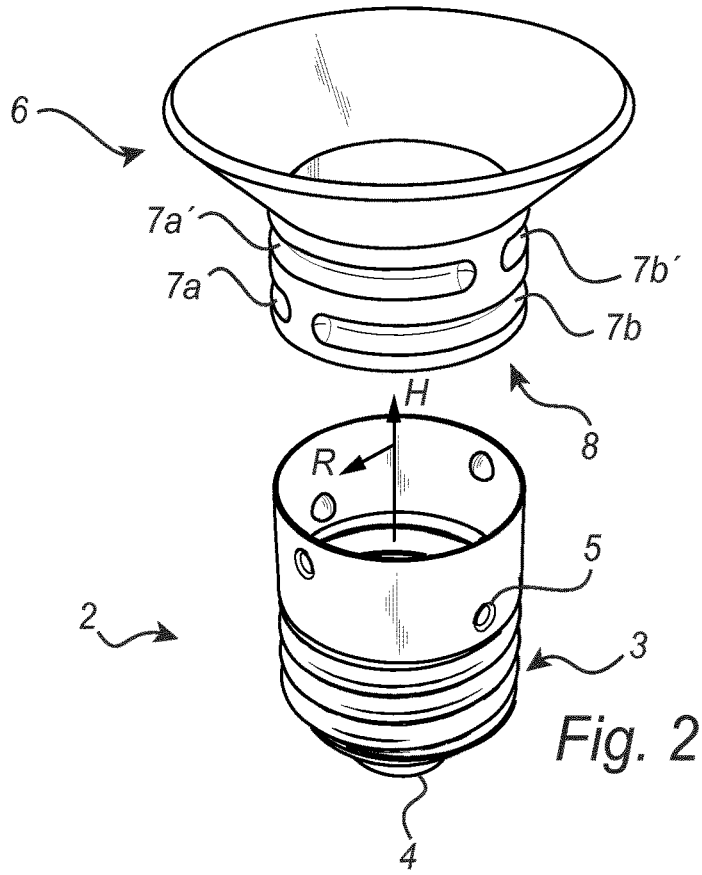
FIGS. 2-3 are schematic illustrations of further examples of bases and shells for rotationally adjustable lamps.

FIG. 2 illustrates a schematic perspective view of a base 2 and a shell 6 which are similar to the ones in FIGS. 1*a*-1*c*. However, the shell 6 in FIG. 2 has an additional pair of oppositely arranged guiding slots 7*a*', 7*b*' on the cylindrical portion 8 of the shell 6. The shell 6 is thus provided with four guiding slots 7*a*, 7*b*, 7*a*', 7*b*'. The guiding slots 7*a*, 7*b*, 7*a*', 7*b*' form a first pair 7*a*, 7*b* and a second pair 7*a*', 7*b*' which are separated from each other along the height of the cylindrical portion 8. Each one of the guiding slots 7*a*, 7*b*, 7*a*', 7*b*' in FIG. 2 extends for about 180 degrees around the cylindrical portion 8.

The base 2 has four notches 5, each of which is arranged to protrude into a corresponding guiding slot when the shell 6 is inserted into the base 2. As is illustrated in FIG. 2, the four notches 5 may be arranged in pairs of two diametrically opposed notches 5. The two pairs of notches 5 are separated along the height direction H and rotated with respect to each other by approximately 90 degrees about an axis in the height direction H. Similarly, the additional pair of guiding slots 7*a*', 7*b*' may be rotated with respect to the other pair of guiding slots 7*a*, 7*b* by approximately 90 degrees about an axis in the height direction H.

Figure 3:
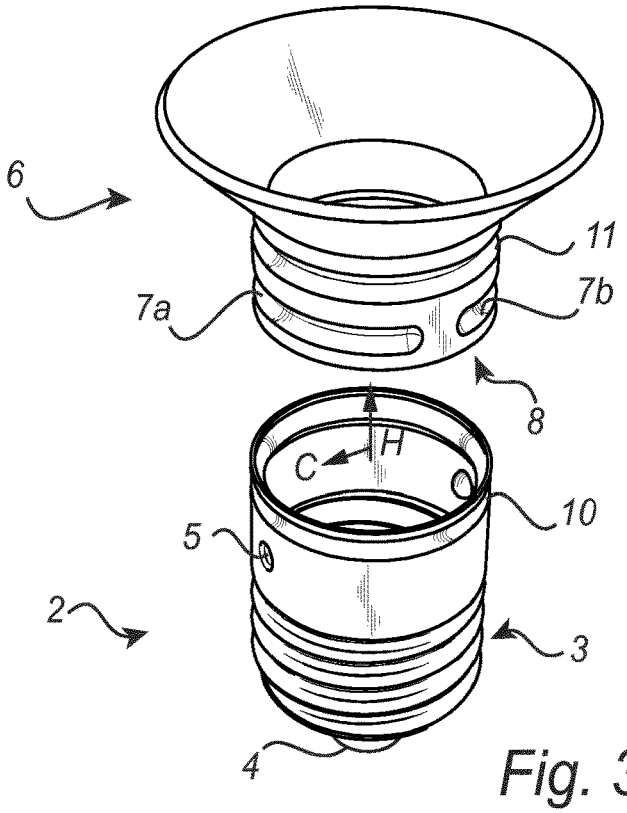

FIG. 3 shows a schematic perspective view of a base 2 having a ring-like depression 10 extending around the entire base 2. The depression 10 is located by the end opposite the bottom portion 4 so that the notches 5 are located between the depression 10 and the bottom portion 4. The shell 6 is provided with a circular slot 11 extending all around the cylindrical portion 8 of the shell 6. The depression 10 is received by the circular slot 11 when the shell 6 is inserted into the base 2, the result being a more stable base and shell assembly.

Figure 4:
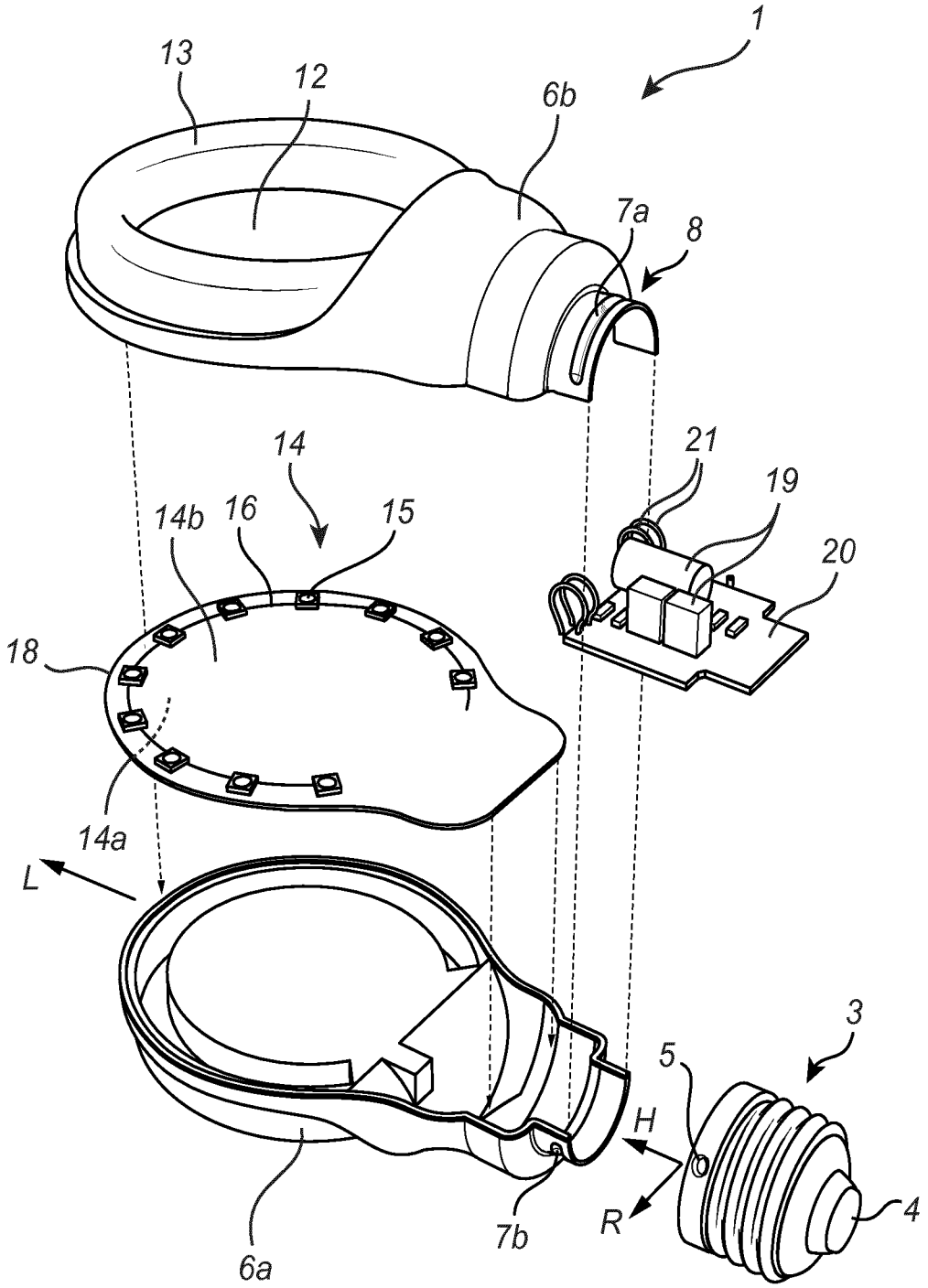
FIGS. 4-5 are schematic illustrations of a rotationally adjustable lamp.

FIG. 4 is a schematic exploded view of a rotationally adjustable lamp 1. The shell 6 in FIG. 4 comprises a first half 6*a* and a second half 6*b*, each of which has a flat central area 12 surrounded by a hollow ridge 13. The first half 6*a* is provided with a guiding slot 7*a* and the second half 6*b* is provided with a guiding slot 7*b*. The lamp 1 has a carrier 14 for supporting at least one light source 15. The carrier 14 may be a circuit board, for example a printed circuit board. The carrier 14 may have a substantially flat shape with two opposite sides 14*a*, 14*b*. At least one light source 15 is arranged on the carrier 14. In FIG. 4, several light sources 15 are arranged on the carrier 14 along a curved portion of the perimeter 18 of the carrier 14. The light sources 15 in FIG. 4 are arranged on both of the two opposite sides 14*a*, 14*b*, although this is not necessary. The light sources 15 may be arranged on only one of the sides 14*a*, 14*b*. The light sources 15 are electrically connected via connections 16. The light sources 15 are typically SSL devices, such as a semiconductor light-emitting diodes, organic light-emitting diodes or polymer light-emitting diode. The light sources 15 may be laser diodes. The lamp 1 may comprise driver circuitry 19. The driver circuitry 19 may be arranged on a separate circuit board 20 connected to the carrier 14 via wires 21.

Figure 5:
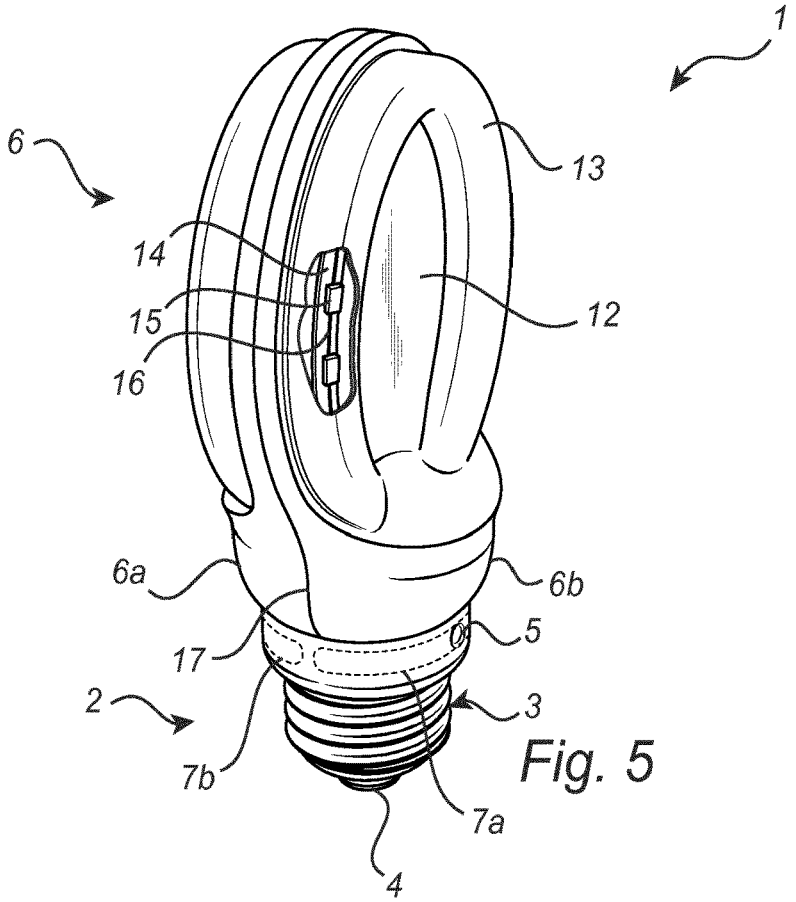

FIG. 5 is a schematic cutaway view in perspective of the rotationally adjustable lamp 1 in FIG. 4 in an assembled configuration with the shell 6 inserted into the base 2. The first 6*a* and second 6*b* halves are attached to each other along a joint 17 contained in a plane parallel to a longitudinal axis L of the lamp 1. The longitudinal axis L is parallel with the height direction H, and in the orientation shown in FIG. 5 the joint 17 is vertical. The first 6*a* and second 6*b* halves may be attached to one another by chemical means, such as glue, or mechanical means, such as nails, screws or clips. The first 6*a* and second 6*b* halves may be soldered together. Welding, for example ultrasonic welding, may be used to attach the first half 6*a* to the second half 6*b*. The first 6*a* and second halves 6*b* enclose the carrier 14 so that the light sources 15 are positioned inside the hollow ridge 13.

When the lamp 1 is in use, electricity is transmitted via the bottom portion 4, the driver circuitry 19 and the connections 16 to the light sources 15 which thereby emit light. The emitted light is transmitted through the shell 6, providing illumination. The notches 5 protrude into, and are movable along, the guiding slots 7*a*, 7*b* of the shell 6 so that the shell 6 is rotatable relative to the base 2.

The rotationally adjustable lamps 1 in FIGS. 1-5 may be manufactured by the method described below with reference to FIG. 6. In step S1, a shell 6 having a guiding slot 7*a* is molded, for example by injection molding. The molded shell 6 may have a cylindrical portion 8 along the circumference of which the guiding slot 7*a* extends. The guiding slot 7*a* may extend along the circumference of the cylindrical portion 8 for about 180 degrees, for instance, and typically extends perpendicular to the height of the cylindrical portion 8.

More than one guiding slot may be formed in the shell 6 during molding. For example, the cylindrical portion 8 may be provided with an additional guiding slot 7*b*. The additional guiding slot 7*b* may be arranged on the cylindrical portion 8 so that the two guiding slots 7*a*, 7*b* form a pair of oppositely arranged guiding slots. According to another example, the cylindrical portion 8 is provided with four guiding slots 7*a*, 7*b*, 7*a*', 7*b*'. The four guiding slots 7*a*, 7*b*, 7*a*', 7*b*' may be arranged on the cylindrical portion 8 so as to form a first pair 7*a*, 7*b* and an additional pair 7*a*', 7*b*', the two guiding slots of each pair being oppositely arranged on the cylindrical portion 8 and the two pairs being separated along the height of the cylindrical portion 8. According to yet another example, a circular slot 11 is formed in the shell 6 during molding. Such a circular slot 11 may extend all around the cylindrical portion 8 of the shell 6.

In step S2, a base 2 is provided. The base 2 is configured to receive the shell 6 and connect to a lamp socket. Typically, the base 2 comprises threads 3 and is configured to be screwed into a lamp socket. If the shell 6 has a circular slot 11, the base 2 provided has a depression 10 to be received by the circular slot 11 when the shell 6 is inserted into the base 2. The steps S1 and S2 may of course be performed in any order.

In step S3, the shell 6 is inserted into the base 2 so that the guiding slot 7*a* is enclosed by the base 2. This may for example be achieved by pushing the cylindrical portion 8 in the height direction H into the base 2.

In step S4, a notch 5 is formed in the base 2. The notch 5 may be formed by pressing the base 2 inwards, i.e. toward the inserted shell 6, at a location such that the notch 5 protrudes into the guiding slot 7*a* and is movable along the guiding slot 7*a* so that the shell 6 and the base 2 are rotatable relative to each other. Note that the step S4 is performed after step S3, i.e. the notch 5 is formed after insertion of the shell 6 into the base 2. If the shell 6 has more than one guiding slot, at least one notch 5 is formed for each guiding slot.

Figure 6:
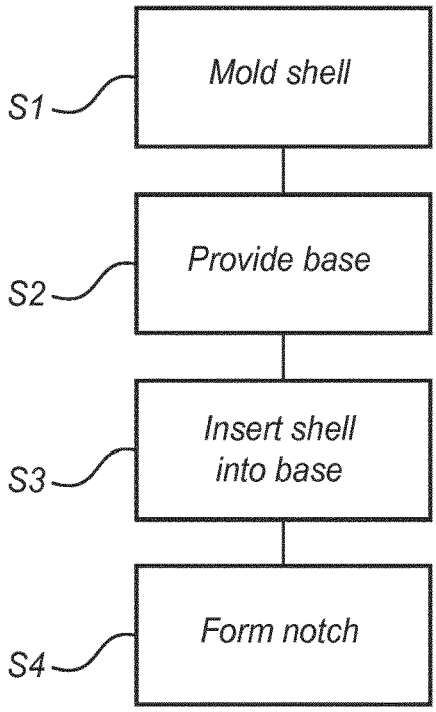
FIG. 6 is a flowchart illustrating some of the steps of a method for manufacturing a rotationally adjustable lamp.

The manufacturing method described above may comprise additional steps besides those illustrated in FIG. 6. For example, molding the shell 6 may include molding a first half 6*a* and a second half 6*b* which are subsequently attached together to form the shell 6. The manufacturing method may also include the steps of providing a carrier 14 having at least one light source 15 and enclosing the carrier 14 between the first 6*a* and second 6*b* halves. The carrier 15 may be a circuit board, for example a printed circuit board. The light source 15 is typically an SSL device, for example a semiconductor light-emitting diode, an organic light-emitting diode or a polymer light-emitting diode. The light source 15 may be a laser diode. The step of inserting the shell 6 into the base 2, i.e. the step S3, is performed after the steps of enclosing the carrier 14 by the two halves 6*a*, 6*b* and attaching the two halves 6*a*, 6*b* to each other. The first 6*a* and second 6*b* halves may be attached to one another by chemical means, such as glue, or mechanical means, such as nails, screws or clips. Soldering may be used to attach the first 6*a* half to the second half 6*b*.

The person skilled in the art realizes that the present invention by no means is limited to the preferred embodiments described above. On the contrary, many modifications and variations are possible within the scope of the appended claims. For example, the shell may have three or more pairs of guiding slots.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. Method for manufacturing a rotationally adjustable lamp, the method comprising:

molding a shell having two guiding slots wherein the guiding slots are arranged in a cylindrical portion of the shell, the guiding slots extending along the circumference of the cylindrical portion and perpendicular to the height of the cylindrical portion, said two guiding slots forming a pair of oppositely arranged guiding slots on the cylindrical portion of the shell, providing a base configured to receive the shell and connect to a lamp socket;

inserting the shell into the base so as to enclose the guiding slots by the base; and forming in the base, when the shell is inserted into the base, a notch protruding into each guiding slot, the notch being movable along the guiding slot so as to allow for the shell to be rotated relative to the base.

2. The method according to claim 1, wherein the guiding slot extends for about 180 degrees.

3. The method according to claim 1, wherein an additional pair of oppositely arranged guiding slots is arranged on the cylindrical portion of the shell, the two pairs of guiding slots being separated along the height of the cylindrical portion.

4. The method according to claim 1, wherein the shell is injection molded.

5. The method according to claim 1, wherein molding the shell comprises molding a first half and a second half of the shell.

6. The method according to claim 5, further comprising providing a carrier having at least one light source and enclosing the carrier between the first and second halves of the shell, before the shell is inserted into the base.

7. The method according to claim 6, wherein the light source is a solid-state lighting device.

8. The method according to claim 5, wherein the shell comprises a joint in a plane parallel to a longitudinal axis of the lamp, the first and second halves being attached to each other along the joint.

9. The method according to claim 5, wherein the carrier has a perimeter including a curved portion, wherein the at least one light source is a plurality of light sources arranged along the curved portion of the perimeter on opposite sides of the carrier, and wherein each half of the shell has a flat central area surrounded by a hollow ridge extending along the curved portion of the perimeter of the carrier.

10. A rotationally adjustable lamp, comprising a base provided with a notch and configured to connect to a lamp socket; and a shell supported by the base and provided with two guiding slots, wherein the guiding slots are arranged in a cylindrical portion of the shell, the guiding slots extending along the circumference of the cylindrical portion and perpendicular to the height of the cylindrical portion, said two guiding slots forming a pair of oppositely arranged guiding slots on the cylindrical portion of the shell, wherein the notch protrudes into each guiding slot and is movable along the guiding slot so as to allow for the shell to be rotated relative to the base.

11. The lamp according to claim 10, wherein the shell has four guiding slots arranged in a cylindrical portion of the shell, each one of the guiding slots extending along the circumference of the cylindrical portion and perpendicular to the height of the cylindrical portion, and wherein the four guiding slots form a first and a second pair of oppositely arranged guiding slots, the two pairs being separated along the height of the cylindrical portion.

12. The lamp according to claim 10, wherein the shell comprises a first half and a second half, the first and second halves enclosing a carrier having a plurality of light sources arranged on opposite sides of the carrier.

* * * * *